US008548690B2

(12) United States Patent
Hayashi

(10) Patent No.: US 8,548,690 B2
(45) Date of Patent: Oct. 1, 2013

(54) BLADE CONTROL SYSTEM AND CONSTRUCTION MACHINE

(75) Inventor: Kazuhiko Hayashi, Komatsu (JP)

(73) Assignee: Komatsu Ltd., Tokyo (JP)

( * ) Notice: Subject to any disclaimer, the term of this patent is extended or adjusted under 35 U.S.C. 154(b) by 117 days.

(21) Appl. No.: 13/249,746

(22) Filed: Sep. 30, 2011

(65) Prior Publication Data

US 2013/0081831 A1 Apr. 4, 2013

(51) Int. Cl.
*E02F 3/76* (2006.01)

(52) U.S. Cl.
USPC ..... 701/50; 172/4.5

(58) Field of Classification Search
USPC ..... 37/342, 348, 319, 314, 414, 419, 37/417; 172/2–11; 701/50; 702/100–105, 702/138, 140, 150–154, 173–175; 414/699, 414/723
See application file for complete search history.

(56) References Cited

U.S. PATENT DOCUMENTS 5,621,643 A 4/1997 Nakagami et al.
5,875,854 A * 3/1999 Yamamoto et al. ..... 172/4.5
5,950,141 A * 9/1999 Yamamoto et al. ..... 702/41
5,951,613 A 9/1999 Sahm et al.
6,044,921 A * 4/2000 Lansberry ..... 180/9.36
6,062,317 A * 5/2000 Gharsalli et al. ..... 172/2
6,068,060 A 5/2000 Ohtomo et al.
6,845,311 B1 * 1/2005 Stratton et al. ..... 701/50
7,451,126 B2 * 11/2008 Hisano et al. ..... 706/50
8,082,084 B2 * 12/2011 Nichols ..... 701/50

FOREIGN PATENT DOCUMENTS

JP 5-106239 A 4/1993
JP 2575991 B2 1/1997
JP 10-141955 A 5/1998
JP 11-256620 A 9/1999
JP 3794763 B2 7/2006

OTHER PUBLICATIONS

International Search Report of corresponding PCT Application No. PCT/JP2012/073149 dated Dec. 18, 2012.

* cited by examiner

*Primary Examiner* — Robert Pezzuto
(74) *Attorney, Agent, or Firm* — Global IP Counselors, LLP

(57) ABSTRACT

A blade control system of the present invention includes a distance calculating part, a blade load obtaining part and a lift cylinder controlling part. The distance calculating part is configured to obtain distance between a designed surface and a cutting edge of a blade. The blade load obtaining part is configured to obtain blade load acting on the blade. The lift cylinder controlling part is configured to execute a dozing control when the aforementioned distance is greater than a first distance. Further, the lift cylinder controlling part is configured to execute a dozing control when the aforementioned distance is less than a second distance.

8 Claims, 9 Drawing Sheets

100
10
50
50S
L1
X
30
40
40P
θ1
UP
DOWN
FRONT
REAR 30
60
60S
L2
70
Y
40
θ2
RIGHT
LEFT
FRONT
REAR

θ3
70S
70
L3
Z
UP
DOWN
RIGHT
LEFT

| | $\Delta Z < D2$ | $D2 \leq \Delta Z \leq D1$ | $D1 < \Delta Z$ |
|---|---|---|---|
| $F < F2$ | LEVELING CONTROL | LEVELING CONTROL | DIGGING CONTROL |
| $F2 \leq F \leq F1$ | | CURRENTLY SELECTED CONTROL | |
| $F1 < F$ | | DIGGING CONTROL | |

FIG. 7

| | $\Delta Z < D2$ | $D2 \leq \Delta Z \leq D1$ | $D1 < \Delta Z$ |
|---|---|---|---|
| $F < F'$ | LEVELING CONTROL | LEVELING CONTROL | DIGGING CONTROL |
| $F' \leq F$ | | DIGGING CONTROL | |

FIG. 9

BLADE CONTROL SYSTEM AND CONSTRUCTION MACHINE

BACKGROUND OF THE INVENTION

1. Technical Field

The present invention relates to a blade control system and a construction machine for causing a cutting edge of a blade to move across a designed surface.

2. Description of the Related Art

Well-known dozing controls, having been proposed for the construction machines (e.g., bulldozers and graders), are configured to automatically adjust the vertical position of a blade for causing a cutting edge of the blade to move across a designed surface indicating a target contour of an object for dozing (see e.g., Japan Laid-open Patent Application Publication No. JP-A-H11-256620).

Meanwhile, well-known dozing controls, having been proposed for the construction machines, are configured to automatically adjust the vertical position of a blade for causing a load of a target level to act on the blade (see e.g., Japan Laid-open Patent Application Publication No. JP-A-H05-106239).

SUMMARY

However, it is difficult for operators to accurately grasp suitable timing for switching between a grading control and a dozing control. When the timing of switching from the dozing control to the grading control is too early, the cutting edge of the blade is deeply shoved into the object for moving across the designed surface, even though there is distance left to reach the designed surface. Blade load is thereby increased and tracks of a drive unit excessively slip against the ground (the phenomenon will be hereinafter referred to as "shoe slippage"). When the timing of switching from the dozing control to the grading control is too late, on the other hand, the cutting edge of the blade excessively dozes the object across the designed surface. Therefore, it has been demanded to execute appropriate automatic switching between the grading control and the dozing control.

The present invention has been produced in view of the above drawback and is intended to provide a blade control system and a construction machine for executing appropriate automatic switching between a grading control and a dozing control.

A blade control system according to a first aspect of the present invention includes a lift frame vertically pivotably attached to a vehicle body; a blade supported by a tip of the lift frame; a lift cylinder configured to vertically pivot the lift frame; a blade load obtaining part configured to obtain a blade load acting on the blade; a distance calculating part configured to calculate a distance between a designed surface and a cutting edge of the blade, the designed surface formed as a three-dimensionally designed surface contour indicating a target contour of an object for dozing; a distance determining part configured to determine a magnitude relation between a first distance and a distance between the designed surface and the cutting edge of the blade and a magnitude relation between a second distance set to be less than the first distance and the distance between the designed surface and the cutting edge of the blade; and a lift cylinder controlling part configured to provide a hydraulic oil to the lift cylinder for executing: a dozing control when the distance determining part determines that the distance between the designed surface and the cutting edge of the blade is greater than the first distance; a grading control when the distance determining part determines that the distance between the designed surface and the cutting edge of the blade is less than the second distance; and either the dozing control or the grading control when the distance determining part determines that the distance between the designed surface and the cutting edge of the blade is greater than or equal to the second distance and less than or equal to the first distance.

According to the blade control system of the first aspect of the present invention, the grading control is configured to be switched into the dozing control when the distance between the designed surface and the cutting edge of the blade is greater than the first distance, then it is possible to inhibit excessive shoe slippage due to excessive blade load. By contrast, the dozing control is configured to be switched into the grading control when the distance between the designed surface and the cutting edge of the blade is less than the second distance, then it is possible to inhibit excessive dozing due to the cutting edge of the blade shoved across the designed surface into an object for dozing. It is thus possible to simultaneously achieve inhibition of excessive shoe slippage and inhibition of excessive dozing by the appropriate automatic switching between the grading control and the dozing control.

It should be noted that the excessive shoe slippage herein refers to a state that driving force of the drive unit cannot be appropriately transferred to the ground due to an excessively increased amount of slippage of the tracks of a drive unit against the ground.

A blade control system according to a second aspect of the present invention relates to the blade control system according to the first aspect of the present invention, and the blade control system further includes a blade load determining part configured to determine a magnitude relation between the blade load and a first load and a magnitude relation between the blade load and a second load set to be less than the first load. Further, under a condition that the distance determining part determines that the distance between the designed surface and the cutting edge of the blade is greater than or equal to the second distance and less than or equal to the first distance, the lift cylinder controlling part is configured to execute: the dozing control when the blade load determining part determines that the blade load is greater than the first load; the grading control when the blade load determining part determines that the blade load is less than the second load; and either the dozing control or the grading control when the blade load determining part determines that the blade load is greater than or equal to the second load and less than or equal to the first load.

According to the blade control system of the second aspect of the present invention, the grading control and the dozing control are switched back and forth in accordance with the blade load when the distance between the designed surface and the cutting edge of the blade falls in a range from the second distance to the first distance. Specifically, when the blade load is small, the grading control is configured to be executed for preventing the cutting edge of the blade from being shoved across the designed surface into an object for dozing, because a large amount of soil can be held when the blade load is small. By contrast, when the blade load is large, the dozing control is configured to be executed, because excessive shoe slippage may result in rough road surface and degradation in operation efficiency when the blade load is large. Put the above together, it is possible to further enhance operation efficiency in addition to inhibition of excessive shoe slippage and inhibition of excessive dozing.

A blade control system according to a third aspect of the present invention relates to the blade control system according to the second aspect of the present invention, under the condition that the distance determining part determines that the distance between the designed surface and the cutting edge of the blade is greater than or equal to the second distance and less than or equal to the first distance, the lift cylinder controlling part is configured to keep currently selected one of the dozing control and the grading control when the blade load determining part determines that the blade load is greater than or equal to the second load and less than or equal to the first load.

According to the blade control system of the third aspect of the present invention, it is possible to inhibit excessive switching between the dozing control and the grading control, then it is possible to reduce load acting on a hydraulic system.

A blade control system according to a fourth aspect of the present invention relates to the blade control system according to the first aspect of the present invention, the distance calculating part is configured to calculate the distance between the designed surface and the cutting edge of the blade based on a vehicle information indicating a vehicle condition and a designed surface information indicating the designed surface.

A blade control system according to a fifth aspect of the present invention relates to the blade control system according to the fourth aspect of the present invention, the vehicle information contains a stroke length of the lift cylinder, a tilting angle of the vehicle body and a GPS data indicating a position of the vehicle body.

A blade control system according to a sixth aspect of the present invention relates to the blade control system according to one of the fourth and fifth aspects of the present invention, the designed surface information contains a designed surface data indicating a position and a contour of the designed surface.

A construction machine according to a seventh aspect of the present invention includes a vehicle body and the blade control system according to the first aspect of the present invention.

A construction machine according to an eighth aspect of the present invention relates to the construction machine according to the seventh aspect and includes a drive unit including a pair of tracks attached to the vehicle body.

Overall, according to the present invention, it is possible to provide a blade control system and a construction machine for appropriately executing automatic switching between a grading control and a dozing control.

BRIEF DESCRIPTION OF THE DRAWINGS

Referring now to the attached drawings which form a part of this original disclosure:

FIG. 7 is a table representing exemplary conditions of switching between a dozing control and a grading control;

FIG. 9 is a table representing other exemplary conditions of switching between the dozing control and the grading control.

DETAILED DESCRIPTION OF THE EMBODIMENTS

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

With reference to attached figures, a bulldozer will be hereinafter explained as an exemplary "construction machine". In the following explanation, the terms "up", "down", "front", "rear", "right" and "left" and their related terms should be understood as directions seen from an operator seated on an operator's seat.

Overall Structure of Bulldozer 100

Figure 1:
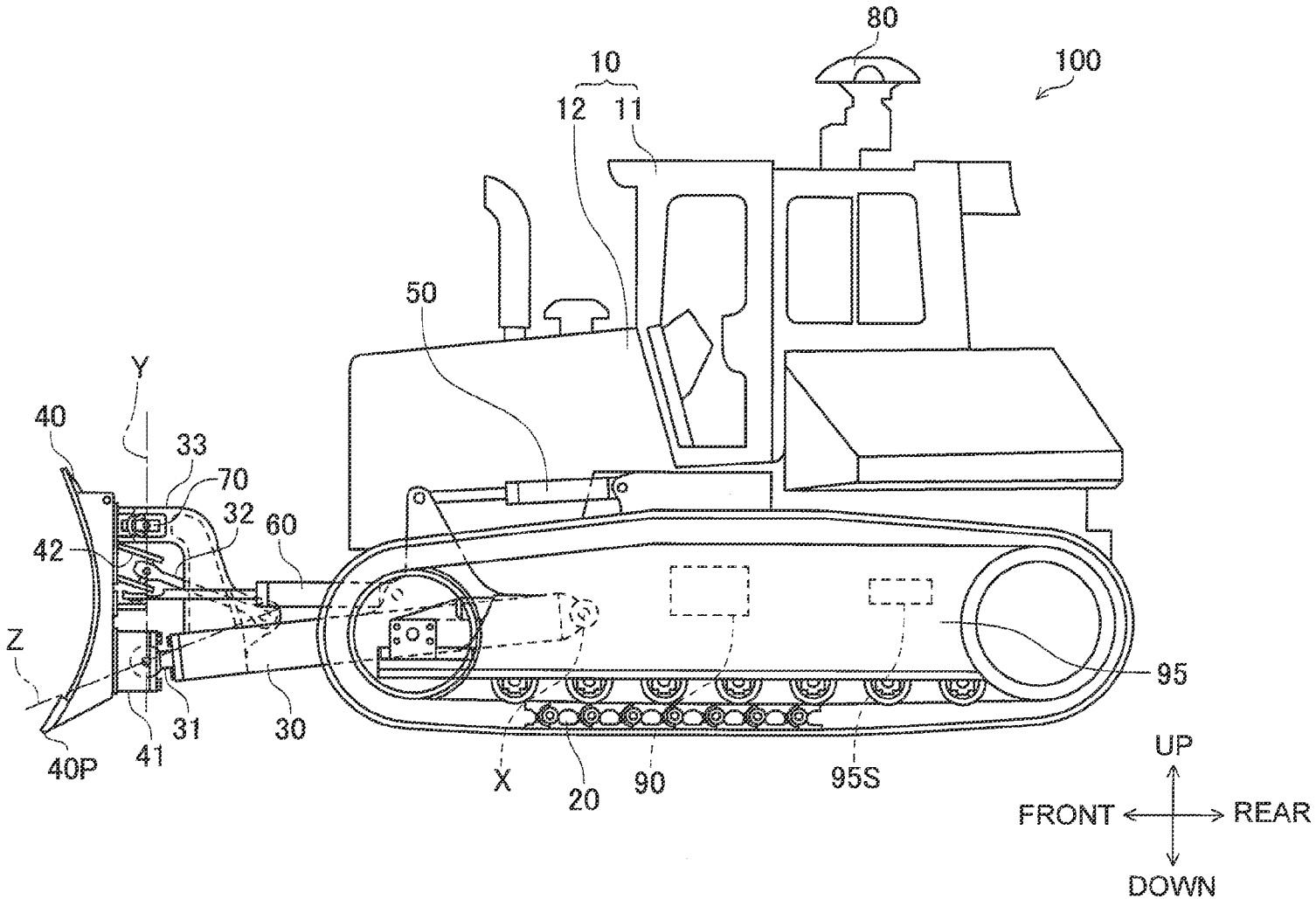
FIG. 1 is a side view of the entire structure of a bulldozer.

FIG. 1 is a side view of the entire structure of a bulldozer 100 according to an exemplary embodiment of the present invention.

The bulldozer 100 includes a vehicle body 10, a drive unit 20, a lift frame 30, a blade 40, a lift cylinder 50, a angling cylinder 60, a tilt cylinder 70, a GPS receiver 80, an IMU (Inertial Measurement Unit) 90, a pair of sprocket wheels 95 and a driving torque sensor 95S. Further, the bulldozer 100 is embedded with a blade control system 200. The structure and actions of the blade control system 200 will be hereinafter described.

The vehicle body 10 includes a cab 11 and an engine compartment 12. Although not illustrated in the figures, the cab 11 is equipped with a seat and a variety of operating devices. The engine compartment 12 is disposed forwards of the cab 11.

The drive unit 20 is formed by a pair of tracks (only the left-side one is illustrated in FIG. 1), and the drive unit 20 is attached to the bottom of the vehicle body 10. The bulldozer 100 is configured to travel when the pair of tracks is rotated in conjunction with driving of the pair of sprocket wheels 95.

The lift frame 30 is disposed inwards of the drive unit 20 in the right-and-left direction of the bulldozer 100. The lift frame 30 is attached to the vehicle body 10 while being vertically pivotable about an axis X arranged in parallel to the right-and-left direction of the bulldozer 100. The lift frame 30 supports the blade 40 through a ball-and-socket joint 31, a pitching support link 32 and a bracing strut 33.

The blade 40 is disposed forwards of the vehicle body 10. The blade 40 is supported by the lift frame 30 through a universal coupling 41 which is coupled to the ball-and-socket joint 31 and a pitching coupling 42 which is coupled to the pitching support link 32. The blade 40 is configured to be lifted up or down in conjunction with upward or downward pivot of the lift frame 30. The blade 40 includes a cutting edge 40P on the bottom end thereof The cutting edge 40P is shoved into the ground in grading or dozing.

The lift cylinder 50 is coupled to the vehicle body 10 and the lift frame 30. In conjunction with extension or contraction of the lift cylinder 50, the lift frame 30 is configured to pivot up and down about the axis X.

The angling cylinder 60 is coupled to the lift frame 30 and the blade 40. In conjunction with extension or contraction of the angling cylinder 60, the blade 40 is configured to be tilted about an axis Y passing through the rotary center of the universal coupling 41 and that of the pitching coupling 42.

The tilt cylinder 70 is coupled to the bracing strut 33 of the lift frame 30 and the right upper end of the blade 40. In conjunction with extension or contraction of the tilt cylinder 70, the blade 40 is configured to rotate about an axis Z connecting the ball-and-socket joint 31 and the bottom end of the pitching support link 32.

The GPS receiver 80 is disposed on the cab 11. The GPS receiver 80 is a GPS (Global Positioning System) antenna. The GPS receiver 80 is configured to receive GPS data indicating the installation position thereof. The GPS receiver 80 is configured to transmit the received GPS data to a blade controller 210 (see FIG. 3) to be described.

The IMU 90 is configured to obtain vehicle body tilting angle data indicating tilting angles of the vehicle body in the front-and-rear direction and the right-and-left direction. The IMU 90 is configured to transmit the vehicle body tilting angle data to the blade controller 210.

The pair of sprocket wheels 95 is configured to be driven by an engine (not illustrated in the figures) accommodated in the engine compartment 12. The drive unit 20 is configured to be driven in conjunction with driving of the pair of sprocket wheels 95.

The driving torque sensor 95S is configured to obtain driving torque data indicating driving torque of the pair of sprocket wheels 95. The driving torque sensor 95S is configured to transmit the obtained driving torque data to the blade controller 210.

Figures 2A, 2B, 2C:
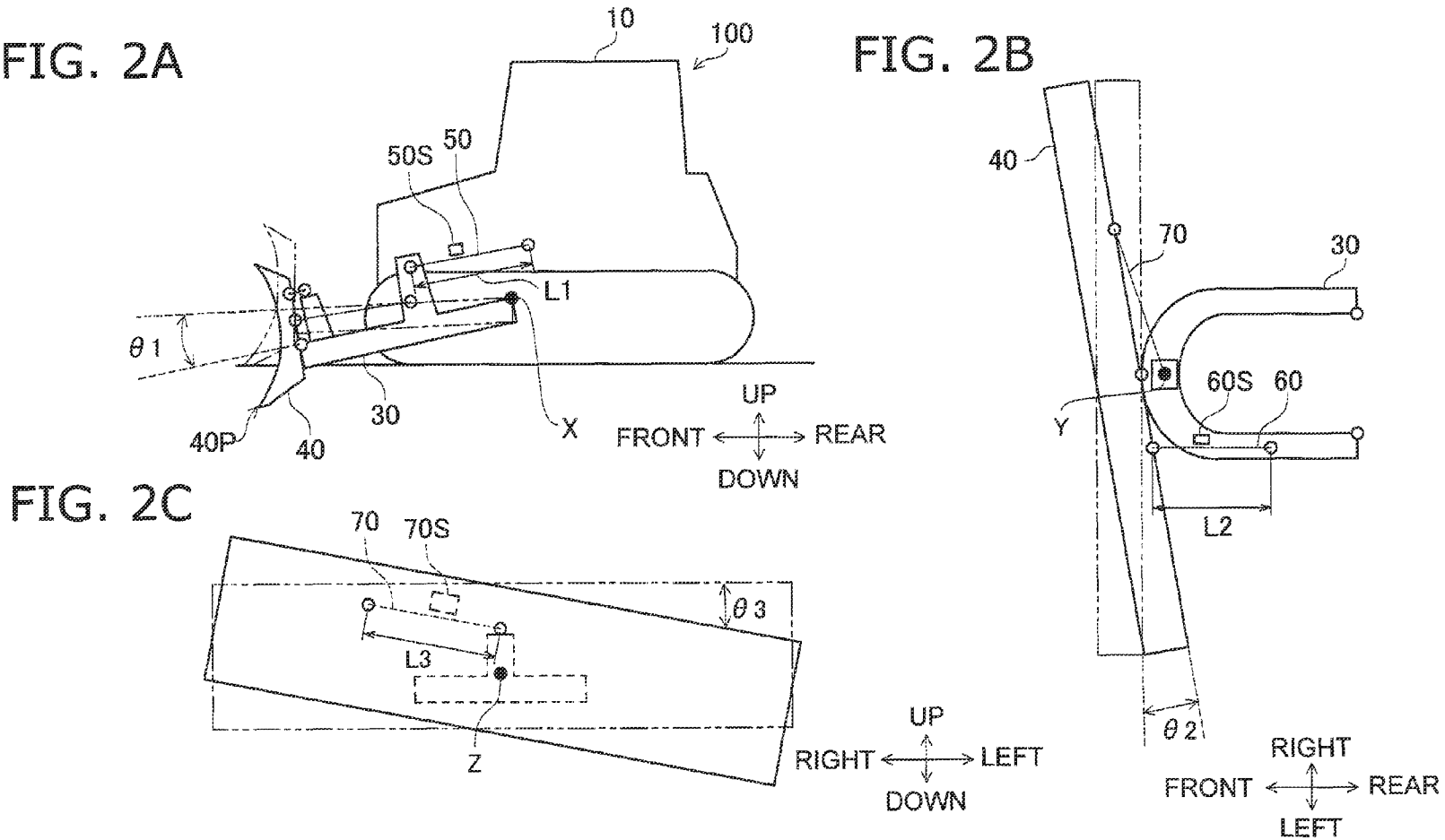
FIG. 2A is a side view of a blade.
FIG. 2B is a top view of the blade.
FIG. 2C is a front view of the blade.

Now, FIGS. 2A to 2C are schematic configuration diagrams of the bulldozer 100. Specifically, FIG. 2A is a side view of the blade 40. FIG. 2B is a top view of the blade 40, and FIG. 2C is a front view of the blade 40. In each of FIGS. 2A to 2C, an original position of the lift frame 30 is depicted with a dashed two-dotted line. When the lift frame 30 is positioned in the original position, the cutting edge 40P of the blade 40 is configured to make contact with the horizontal ground.

As illustrated in FIGS. 2A to 2C, the bulldozer 100 includes a lift cylinder sensor 50S, an angling cylinder sensor 60S and a tilt cylinder sensor 70S. Each of the lift cylinder sensor 50S, the angling cylinder sensor 60S and the tilt cylinder sensor 70S is formed by a rotatable roller configured to detect the position of a cylinder rod and a magnetic sensor configured to return the cylinder rod to the original position.

As illustrated in FIG. 2A, the lift cylinder sensor 50S is configured to detect the stroke length of the lift cylinder 50 (hereinafter referred to as "a lift cylinder length L1") and transmit the detected lift cylinder length L1 to the blade controller 210. In turn, the blade controller 210 is configured to calculate a blade lifting angle θ1 of the blade 40 based on the lift cylinder length L1. In the present exemplary embodiment, the blade lifting angle θ1 corresponds to a lowered angle of the blade 40 from the original position, i.e., the depth of the cutting edge 40P shoved into the ground. A method of calculating the blade lifting angle θ1 will be hereinafter described.

As illustrated in FIG. 2B, the angling cylinder sensor 60S is configured to detect the stroke length of the angling cylinder 60 (hereinafter referred to as "an angling cylinder length L2") and transmit the detected angling cylinder length L2 to the blade controller 210. As illustrated in FIG. 2C, the tilt cylinder sensor 70S is configured to detect the stroke length of the tilt cylinder 70 (hereinafter referred to as "a tilt cylinder length L3") and transmit the detected tilt cylinder length L3 to the blade controller 210. The blade controller 210 is configured to calculate a blade tilting angle θ2 and a blade tilting angle θ3 of the blade 40 based on the angling cylinder length L2 and the tilt cylinder length L3.

Structure of Blade Control System 200

Figure 3:
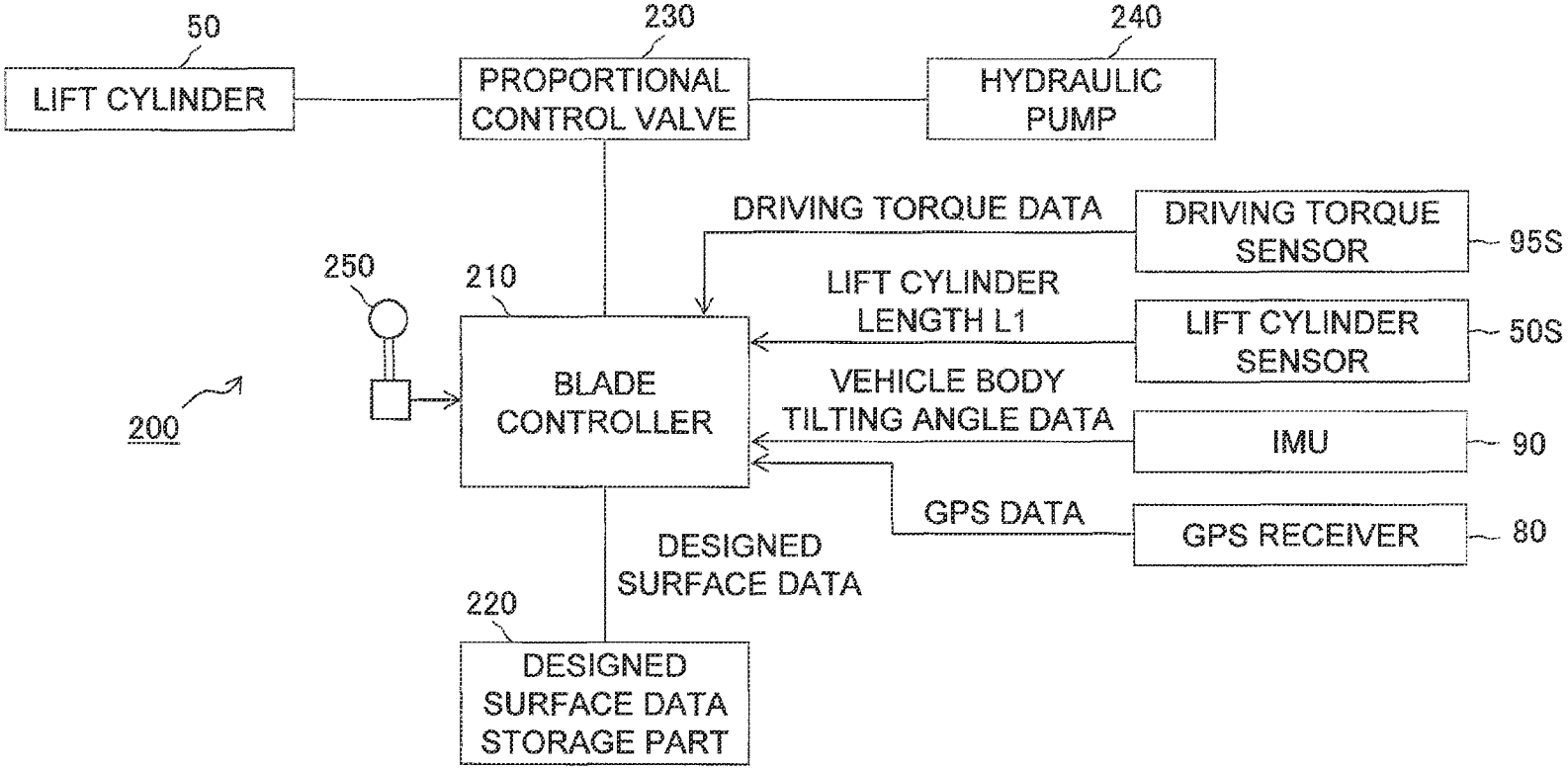
FIG. 3 is a configuration block diagram of a blade control system.

FIG. 3 is a configuration block diagram of the blade control system 200 according to the present exemplary embodiment.

The blade control system 200 includes the blade controller 210, a designed surface data storage 220, a proportional control valve 230, a hydraulic pump 240 and a reverse shift lever 250 in addition to the aforementioned elements including the lift cylinder 50, the lift cylinder sensor 50S, the GPS receiver 80, the IMU 90 and the driving torque sensor 95S.

The blade controller 210 is configured to obtain the lift cylinder length L1 from the lift cylinder sensor 50S. Further, the blade controller 210 is configured to obtain the GPS data from the GPS receiver 80, obtain the vehicle body tilting angle data from the IMU 90, and obtain the driving torque data from the driving torque sensor 95S. The blade controller 210 is configured to output electric current as a control signal based on the above information to the proportional control valve 230. Functions of the blade controller 210 will be hereinafter described.

The designed surface data storage 220 has been preliminarily stored designed surface data indicating the position and the contour of a three-dimensionally designed surface contour (hereinafter referred to as "a designed surface M"), which indicates a target contour of an object for dozing within a work area.

The proportional control valve 230 is disposed between the lift cylinder 50 and the hydraulic pump 240. The open ratio of the proportional control valve 230 is configured to be controlled by the electric current outputted from the blade controller 210 as a control signal.

The hydraulic pump 240 is configured to be operated in conjunction with the engine, and the hydraulic pump 240 is configured to supply hydraulic oil to the lift cylinder 50 via the proportional control valve 230. It should be noted that the hydraulic pump 240 can supply the hydraulic oil to the angling cylinder 60 and the tilt cylinder 70 via proportional control valves different from the proportional control valve 230.

The reverse shift lever 250 is disposed within the cab 11. The reverse shift lever 250 is an operating tool for reversing the rotational direction of the pair of sprocket wheels 95. An operator is allowed to backwardly move the bulldozer 100 to a starting position through the operation of the reverse shift lever 250 every time either grading or dozing is finished for a path.

Functions of Blade Controller 210

Figure 4:
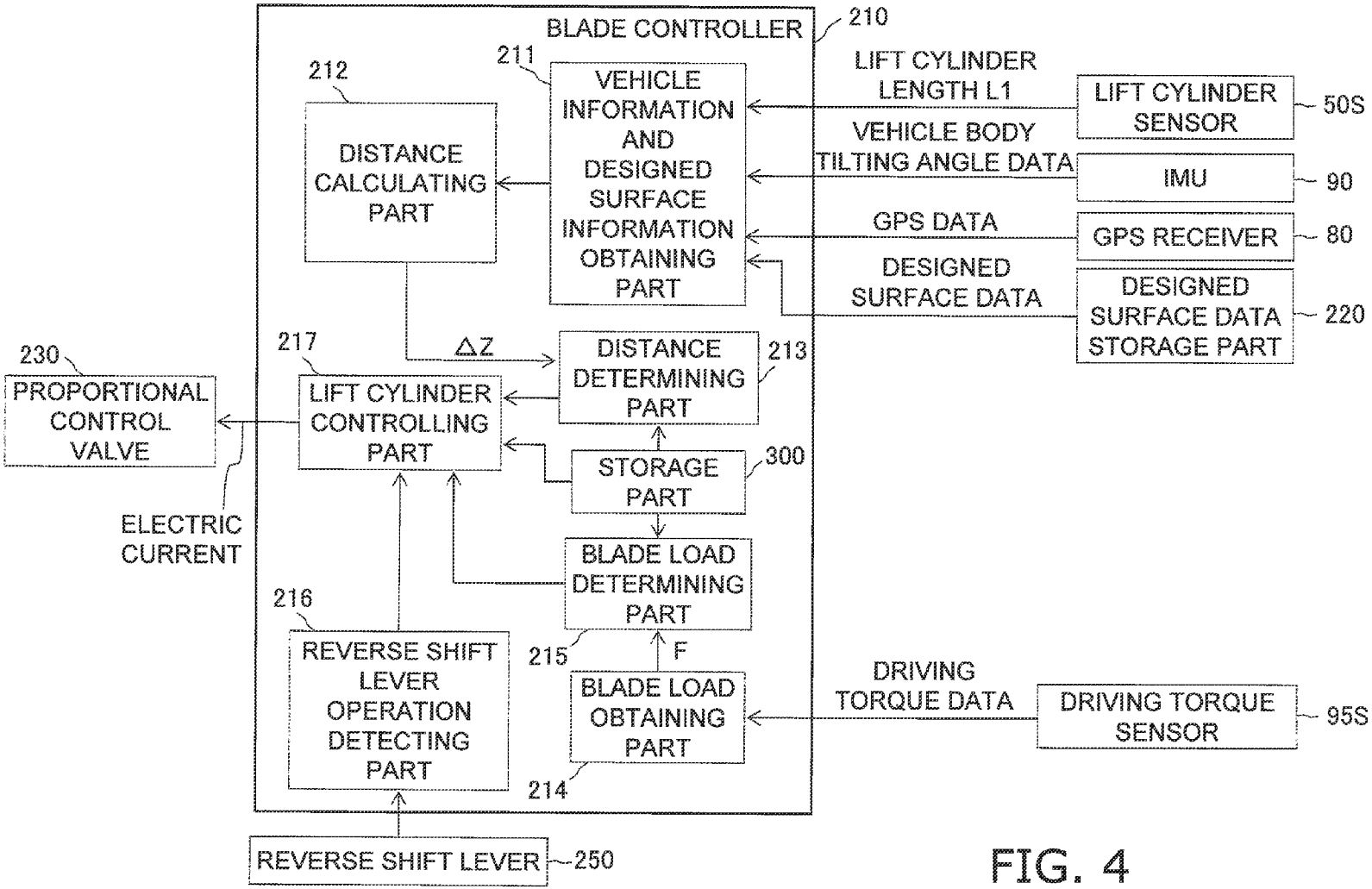
FIG. 4 is a functional block diagram of a blade controller.
Figure 5:
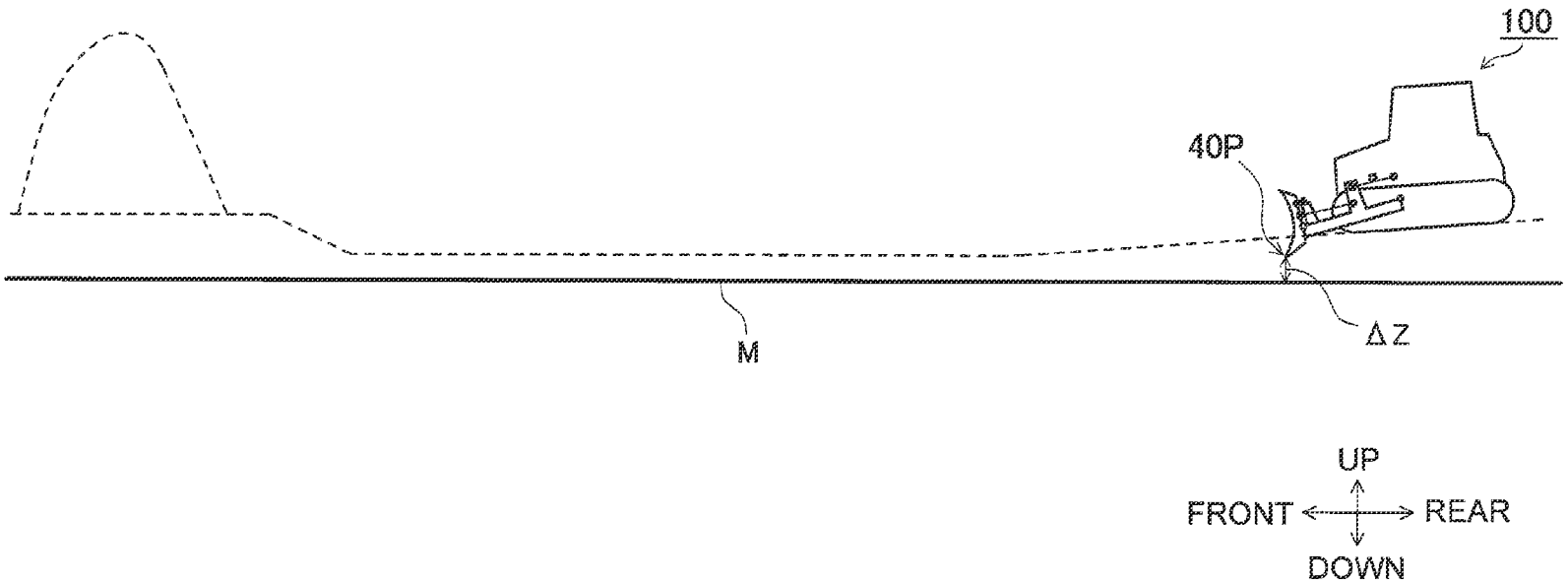
FIG. 5 is a schematic diagram of an exemplary positional relation between the bulldozer and a designed surface.

FIG. 4 is a functional block diagram of the blade controller 210. FIG. 5 is a schematic diagram for illustrating an exemplary positional relation between the bulldozer 100 and the designed surface M.

As represented in FIG. 4, the blade controller 210 includes a vehicle information and designed surface information obtaining part 211, a distance calculating part 212, a distance determining part 213, a blade load obtaining part 214, a blade load determining part 215, a reverse shift lever operation detecting part 216, a lift cylinder controlling part 217 and a storage part 300.

The vehicle information and designed surface information obtaining part 211 is configured to obtain the lift cylinder length L1, the GPS data, the vehicle body tilting angle data and the designed surface data. In the present exemplary embodiment, the lift cylinder length L1, the GPS data and the vehicle body tilting angle data correspond to "vehicle information" whereas the designed surface data corresponds to "designed surface information".

The distance calculating part 212 stores vehicle body size data of the bulldozer 100. As illustrated in FIG. 5, the distance calculating part 212 is configured to obtain a distance ΔZ between the designed surface M and the cutting edge 40P based on the lift cylinder length L1, the GPS data, the vehicle body tilting angle data, the designed surface data and the vehicle body size data either on a real time basis or at predetermined time intervals. It should be noted that the predetermined time interval herein refers to, for instance, timing corresponding to the processing speed of the blade controller 210. Specifically, the shortest sampling time is set to be 10 milliseconds (msec) where the processing speed of the blade controller 210 is set to be 100 Hz.

Figure 6:
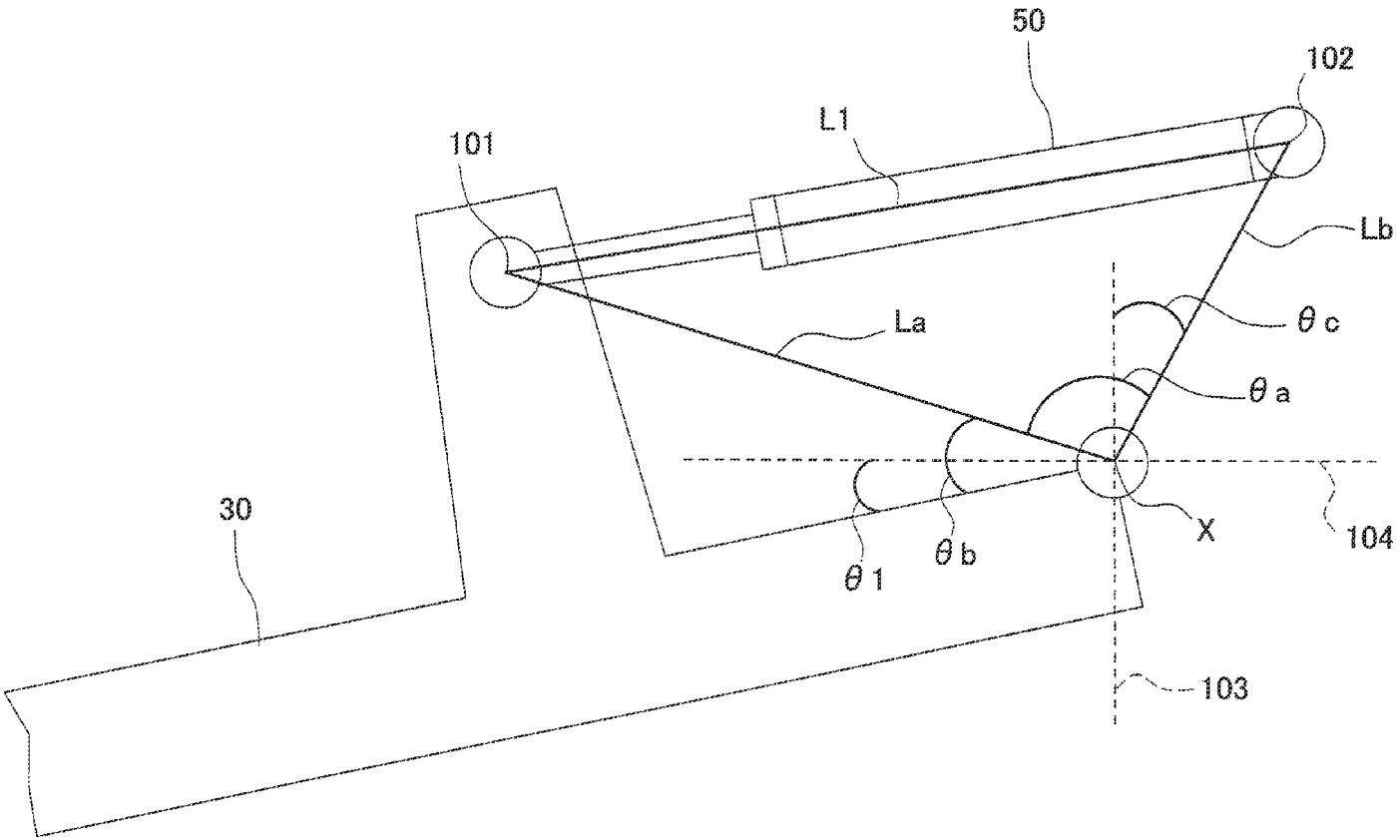
FIG. 6 is a schematic diagram for explaining a method of calculating a lifting angle.

It should be noted that the distance calculating part 212 is configured to calculate the lifting angle θ1 based on the lift cylinder length L1. Now, FIG. 6 is a partially enlarged view of FIG. 2A and schematically explains a method of calculating the lifting angle θ1. As illustrated in FIG. 6, the lift cylinder 50 is attached to the lift frame 30 while being rotatable about a front-side rotary axis 101 and the lift cylinder 50 is attached to the vehicle body 10 while being rotatable about a rear-side rotary axis 102. In FIG. 6, a vertical line 103 is a straight line arranged along the vertical direction and an original position indicating line 104 is a straight line indicating the original position of the blade 40. Further, a first length La is the length of a straight line segment connecting the front-side rotary axis 101 and an axis X of the lift frame 30, and a second length Lb is the length of a straight line segment connecting the rear-side rotary axis 102 and the axis X of the lift frame 30. Further, a first angle θa is formed between the front-side rotary axis 101 and the rear-side rotary axis 102 around the axis X as the vertex of the first angle θa, and a second angle θb is formed between and the front-side rotary axis 101 and the upper face of the lift frame 30 around the axis X as the vertex of the first angle θb, and a third angle θc is formed between the rear-side rotary axis 102 and the vertical line 103 around the axis X as the vertex of the first angle θc. The first length La, the second length Lb, the second angle θb and the third angle θc are fixed values and are stored in the distance calculating part 212. Radian is herein set as the unit for the second angle θb and that of the third angle θc.

First, the distance calculating part 212 is configured to calculate the first angle θa using the following equations (1) and (2) based on the law of cosines.

$$L1^2=La^2+Lb^2-2LaLb\times\cos(\theta a) \quad (1)$$

$$\theta a=\cos^{-1}((La^2+Lb^2-L1^2)/2LaLb) \quad (2)$$

Next, the distance calculating part 212 is configured to calculate the blade lifting angle θ1 using the following equation (3)

$$\theta 1=\theta a+\theta b-\theta c-\pi/2 \quad (3)$$

Then, the distance calculating part 212 is configured to use the above calculated lifting angle θ1 for obtaining the distance ΔZ.

The storage part 300 stores a variety of information used for controls by the blade controller 210. Specifically, the storage part 300 stores a first distance D1 and a second distance D2 which are used by the distance determining part 213 as thresholds of the distance ΔZ between the designed surface M and the cutting edge 40P. The second distance D2 is less than the first distance D1. The first and second distances D1 and D2 can be arbitrarily set in accordance with the vehicle rank or the vehicle weight of the bulldozer 100. For example, the first distance D1 can be set to be roughly 100 mm, while the second distance D2 can be set to be roughly 0 to 10 mm, but settings of the first and second distance D1 and D2 are not limited to the above.

Further, the storage part 300 stores a first load F1 and a second load F2 which are used by the blade load determining part 215 as thresholds of load acting on the blade 40 (hereinafter referred to as "blade load"). The second load F2 is less than the first load F1. The first and second loads F1 and F2 can be arbitrarily set in accordance with the vehicle rank or the vehicle weight of the bulldozer 100. For example, the first load F1 can be set to be in a range from 0.5 to 0.7 times as much as a vehicle weight W of the bulldozer 100, while the second load F2 can be set to be in a range from 0.2 to 0.4 times as much as the vehicle weight W of the bulldozer 100, but settings of the first and second loads F1 and F2 are not limited to the above.

Yet further, the storage part 300 stores a target load set as a target value of the blade load. The target load has been preliminarily set in consideration of balance between the dozing amount and slippage of the tracks of the drive unit against the ground (hereinafter referred to as "shoe slippage"), for example, the target load can be arbitrarily set to be in a range from 0.5 to 0.7 times as much as the vehicle weight W of the bulldozer 100. It should be noted that excessive shoe slippage hereinafter refers to a condition that driving force of the drive unit cannot be appropriately transmitted to the ground due to an excessively increased amount of slippage of the tracks against the ground.

Yet further, the storage part 300 stores a table as represented in FIG. 7, i.e., "a table of conditions for switching between a dozing control and a grading control". The table of conditions is used for an operation by the lift cylinder controlling part 217 for switching between the dozing control and the grading control.

The distance determining part 213 is configured to determine whether or not the distance ΔZ obtained by the distance calculating part 212 is greater than the first distance D1. Further, the distance determining part 213 is configured to determine whether or not the distance ΔZ is less than the second distance D2 that is less then the first distance D1. The distance determining part 213 is configured to inform the lift cylinder controlling part 217 of the determination results.

The blade load obtaining part 214 is configured to obtain the driving torque data, indicating driving torque of the pair of sprocket wheels 95, from the driving torque sensor 95S either on a real time basis or at predetermined time intervals. Further, the blade load obtaining part 214 is configured to obtain a blade load F acting on the blade 40 based on the driving torque data. The blade load corresponds to so-called "traction force". For example, the blade load obtaining part 214 can obtain the blade load F by multiplying a value of driving torque by a reduction ratio of the pair of sprocket wheels 95.

The blade load determining part 215 is configured to determine whether or not the blade load F obtained by the blade load obtaining part 214 is greater than the first load F1. Further, the blade load determining part 215 is configured to determine whether or not the blade load F is less than the second load F2. The blade load determining part 215 is configured to inform the lift cylinder controlling part 217 of the determination results.

The reverse shift lever operation detecting part 216 is configured to detect that an output shaft of the engine and a reverse gear are coupled in response to an operator's operation of the reverse shift lever 250. When detecting the operation of the reverse shift lever 250, the reverse shift lever operation detecting part 216 is configured to inform the lift cylinder controlling part 217 of the detection.

The lift cylinder controlling part 217 is configured to output electric current as a control signal to the proportional control valve 230 for supplying the hydraulic oil to the lift cylinder 50. The lift cylinder controlling part 217 is configured to adjust the vertical position of the blade 40 through the supply of the hydraulic oil.

Further, the lift cylinder controlling part 217 is configured to switch between the dozing control and the grading control with reference to the table of switching conditions represented in FIG. 7 in accordance with the determination results informed by the distance determining part 213 and the blade load determining part 215. The dozing control herein refers to a control of keeping the blade load F at the target load for efficiently executing dozing. The grading control herein refers to a control of keeping the distance ΔZ between the cutting edge 40P and the designed surface M at a target distance Dt for forming a surface in a target contour. The target distance Dt can be set to be "roughly 0 mm", but a setting of the target distance Dt is not limited to the above. When the target distance Dt is set to be "roughly 0 mm", it is possible to cause the cutting edge 40P to track the designed surface M.

As represented in FIG. 7, the lift cylinder controlling part 217 is specifically configured to: execute the dozing control when the distance ΔZ is greater than the first distance D1; and execute the grading control when the distance ΔZ is less than the second distance D2. Further, the lift cylinder controlling part 217 is configured to execute either the dozing control or the grading control when the distance ΔZ is greater than or equal to the second distance D2 and less than or equal to the first distance D1.

Further as represented in FIG. 7, under the condition that the distance ΔZ is greater than or equal to the second distance D2 and less than or equal to the first distance D1, the lift cylinder controlling part 217 is configured to: execute the dozing control when the blade load F is greater than the first load F1; and execute the grading control when the blade load F is less than the second load F2. Further, the lift cylinder controlling part 217 is configured to keep currently selected one of the dozing control and the grading control when the blade load F is greater than or equal to the second load F2 and less than or equal to the first load F1. In other words, the lift cylinder controlling part 217 is herein configured not to execute switching between the dozing control and the grading control.

Further, the lift cylinder controlling part 217 is configured to finish executing the dozing/grading control when an operation of the reverse shift lever 250 is detected by the reverse shift lever operation detecting part 216. The lift cylinder control controlling 217 is then configured to restart executing the dozing/grading control (i.e., switching between the dozing control and the dozing control) when the operation of the reverse shift lever 250 is no longer detected by the reverse shift lever operation detecting part 216.

Actions of Blade Control System 200

Figure 8:
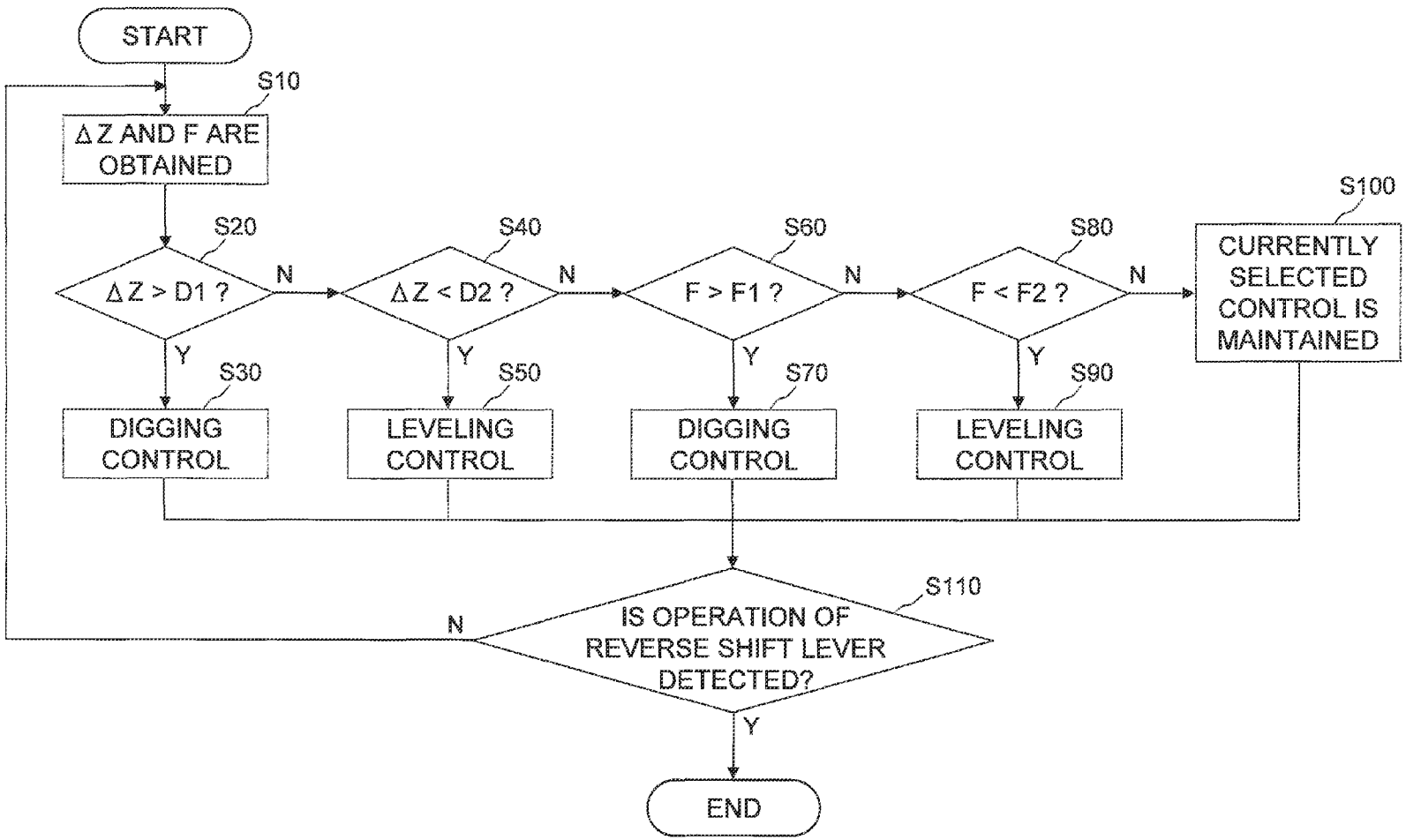
FIG. 8 is a flowchart for explaining actions of the blade control system.

FIG. 8 is a flowchart for explaining the actions of the blade control system 200 according to an exemplary embodiment of the present invention. It should be noted that the following explanation mainly focuses on the actions of the blade controller 210.

In Step S10, the blade controller 210 obtains the distance ΔZ based on the lift cylinder length L1, the GPS data, the vehicle body tilting angle data, the designed surface data and the vehicle body size data, and the blade controller 210 obtains the blade load F based on the driving torque data.

In Step S20, the blade controller 210 determines whether or not the distance ΔZ is greater than the first distance D1. The processing proceeds to Step S30 when the blade controller 210 determines that the distance ΔZ is greater than the first distance D1, and the blade controller 210 executes the dozing control in Step S30. By contrast, the processing proceeds to Step S40 when the blade controller 210 determines that the distance ΔZ is not greater than the first distance D1.

In Step S40, the blade controller 210 determines whether or not the distance ΔZ is less than the second distance D2 (<the first distance D1). The processing proceeds to S50 when the blade controller 210 determines that the distance ΔZ is less than the second distance D2, and the blade controller 210 executes the grading control in Step S50. By contrast, the processing proceeds to Step S60 when the blade controller 210 determines that the distance ΔZ is not less than the second distance D2 (i.e., when the distance ΔZ is greater than or equal to the second distance D2 and less than or equal to the first distance D1).

In Step S60, the blade controller 210 determines whether or not the blade load F is greater than the first load F1. The processing proceeds to Step S70 when the blade controller 210 determines that the blade load F is greater than the first load F1, and the blade controller 210 executes the dozing control in Step S70. By contrast, the processing proceeds to Step S80 when the blade controller 210 determines that the blade load F is not greater than the first load F1.

In Step S80, the blade controller 210 determines whether or not the blade load F is less than the second load F2 (<the first load F1). The processing proceeds to Step S90 when the blade controller 210 determines that the blade load F is less than the second load F2, and the blade controller 210 executes the grading control in Step S90. By contrast, the processing proceeds to Step S100 when the blade controller 210 determines that the blade load F is not less than the second load F2.

In Step S100, the blade controller 210 keeps the currently selected one of the dozing control and the grading control without switching between the dozing control and the grading control. However, the blade controller 210 may have an initial setting of executing predetermined one of the dozing control and the grading control when the processing proceeds to Step S100 in the first processing routine.

In Step S110 immediately after Steps S30, S50, S70, S90 and S100, the blade controller 210 determines whether or not an operation of the reverse shift lever 250 is detected. The processing ends when the blade controller 210 determines that the operation of the reverse shift lever 250 is detected. By contrast, the processing returns to Step S10 when the blade controller 210 determines that the operation of the reverse shift lever 250 is not detected.

Working Effects (1) The blade control system 200 includes the distance calculating part 212, the blade load obtaining part 214 and the lift cylinder controlling part 217. The distance calculating part 212 is configured to obtain the distance ΔZ between the designed surface M and the cutting edge 40P. The blade load obtaining part 214 is configured to obtain the blade load F (so-called "dozing resistance") acting on the blade 40. The lift cylinder controlling part 217 is configured to execute "the dozing control" for regulating the blade load F at the target load when the distance ΔZ is greater than the first distance D1. Further, the lift cylinder controlling part 217 is configured to execute "the grading control" for regulating the distance ΔZ at the target distance Dt when the distance ΔZ is less than the second distance D2.

According to the blade control system 200, the grading control is configured to be switched into the dozing control when the distance ΔZ is greater than the first distance D1, then it is possible to inhibit excessive shoe slippage due to the blade load F excessively acting on the blade 40. On the other hand, the dozing control is configured to be switched into the grading control when the distance ΔZ is less than the second distance D2, then it is possible to inhibit excessive dozing due to the cutting edge 40 shoved across the designed surface M into the ground. It is thus possible to simultaneously inhibit excessive shoe slippage and excessive dozing by appropriately executing the automatic switching between the grading control and the dozing control.

(2) Under the condition that the distance ΔZ is greater than or equal to the second distance D2 and less than or equal to the first distance D1, the lift cylinder controlling part 217 is configured to: execute the dozing control when the blade load F is greater than the first load F1; and execute the grading control when the blade load F is less than the second load F2.

According to the blade control system 200, the grading control and the dozing control are configured to be switched back and forth in accordance with the blade load F when the distance ΔZ is in a range of the second distance D2 to the first distance D1. Specifically, the grading control is configured to be executed when the blade load F is small because a greater amount of soil can be held when the blade load F is small. By contrast, the dozing control is configured to be executed when the blade load F is large because excessive shoe slippage may result in degradation in work efficiency and the rough road surface when the blade load F is large. It is consequently possible to achieve enhancement of work efficiency in addition to inhibition of excessive shoe slippage and inhibition of excessive dozing.

(3) The lift cylinder controlling part 217 is configured to keep currently selected one of the dozing control and the grading control when the distance ΔZ is greater than or equal to the second distance D2 and less than or equal to the first distance D1, and further, when the blade load F is greater than or equal to the second load F2 and less than or equal to the first load F1.

It is thus possible to inhibit excessive switching between the dozing control and the grading control, then it is possible to reduce load acting on the hydraulic system.

Other Exemplary Embodiments

An exemplary embodiment of the present invention has been explained above, but the present invention is not limited to the aforementioned exemplary embodiment, and a variety of changes can be herein made without departing from the scope of the present invention.

(A) In the aforementioned exemplary embodiment, the lift cylinder controlling part 217 is configured to regulate the blade load F at the target load under the dozing control, but the target load for the blade load F may not be a fixed value. For example, the lift cylinder controlling part 217 may be configured to reduce the target load in proportion to reduction in the distance ΔZ. Accordingly, it is possible to inhibit the graded surface from being roughened.

(B) Although not particularly described in the aforementioned exemplary embodiment, the lift cylinder controlling part 217 may be configured to set ahead the timing of starting elevation of the blade 40 in proportion to the speed of the blade 40 approaching the designed surface M when the dozing control is switched into the grading control. In this case, the blade control system 200 may include a speed obtaining part and a determining part. The speed obtaining part is herein configured to differentiate the distance ΔZ by time for obtaining a speed V of the cutting edge 40P with respect to the designed surface M. The determining part is herein configured to determine whether or not the distance ΔZ is less than or equal to a threshold $Z_{TH}$ to be determined based on the speed V. In this case, the lift cylinder controlling part 217 starts elevation of the blade 40 when the determining part determines that the distance ΔZ is less than or equal to the threshold $Z_{TH}$, then it is possible to further inhibit the cutting edge 40P from being shoved across the designed surface M into the ground.

(C) Although not particularly described in the aforementioned exemplary embodiment, the lift cylinder controlling part 217 may be configured to increase the speed of elevating the blade 40 in inverse proportion to the vertical position of the blade 40 when the dozing control is switched into the grading control. In this case, the blade controller 210 may include an angle obtaining part which is herein configured to obtain an angle Δθ of the lift frame 30 with respect to the designed surface M and an open ratio determining part which is herein configured to determine the open ratio S based on the angle Δθ. Further, the lift cylinder controlling part 217 is herein configured to open the proportional control valve 230 in accordance with the open ratio S for starting elevation of the blade 40 when it is determined that the distance ΔZ is less than or equal to the threshold $Z_{TH}$, then it is possible to further inhibit the cutting edge 40P from being shoved across the designed surface M into the ground due to delay of the timing of elevating the blade 40.

(D) In the aforementioned exemplary embodiment, as represented in FIG. 7, the blade controller 210 is configured to switch between the dozing control and the grading control in accordance with three ranges of the blade load F, which are sectioned by the first load F1 and the second load F2, but conditions for switching between the dozing control and the grading control are not limited to the above. As illustrated in FIG. 9, for instance, the dozing control and the grading control may be configured to be switched back and forth in accordance with two ranges of the blade load F, which are sectioned by a single load F'. It should be noted that an example of FIG. 9 does not include the range of "F2≤F≤F1" represented in FIG. 7.

(E) In the aforementioned exemplary embodiment, as represented in FIG. 7, the lift cylinder controlling part 217 is configured to keep currently selected one of the dozing control and the grading control when the blade load F is greater than or equal to the second load F2 and less than or equal to the first load F1, but configuration of executing the dozing control or the grading control is not limited to the above. For example, either the dozing control or the grading control may be configured to be executed when no current control information exists (e.g., in start-up of the blade control system 200).

(F) In the aforementioned exemplary embodiment, the bulldozer has been explained as an exemplary "construction machine". In the present invention, however, the construction machine is not limited to the bulldozer, and may be any suitable construction machines such as a motor grader.

What is claimed is:

1. A blade control system, comprising:

a lift frame vertically pivotably attached to a vehicle body;

a blade supported by a tip of the lift frame;

a lift cylinder configured to vertically pivot the lift frame;

a blade load obtaining part configured to obtain a blade load acting on the blade;

a distance calculating part configured to calculate a distance between a designed surface and a cutting edge of the blade, the designed surface formed as a three-dimensionally designed surface contour indicating a target contour of an object for dozing;

a distance determining part configured to determine a magnitude relation between a first distance and a distance between the designed surface and the cutting edge of the blade and a magnitude relation between a second distance set to be less than the first distance and the distance between the designed surface and the cutting edge of the blade; and a lift cylinder controlling part configured to provide a hydraulic oil to the lift cylinder tier executing: a dozing control when the distance determining part determines that the distance between the designed surface and the cutting edge of the blade is greater than the first distance; a grading control when the distance determining part determines that the distance between the designed surface and the cutting edge of the blade is less than the second distance; and either the dozing control or the grading control when the distance determining part determines that the distance between the designed surface and the cutting edge of the blade is greater than or equal to the second distance and less than or equal to the first distance.

2. The blade control system according to claim 1, further comprising:

a blade load determining part configured to determine a magnitude relation between the blade load and a first load and a magnitude relation between the blade load and a second load set to be less than the first load, wherein under a condition that the distance determining part determines that the distance between the designed surface and the cutting edge of the blade is greater than or equal to the second distance and less than or equal to the first distance, the lift cylinder controlling part is configured to execute: the dozing control when the blade load determining part determines that the blade load is greater than the first load; the grading control when the blade load determining part determines that the blade load is less than the second load; and either the dozing control or the grading control when the blade load determining part determines that the blade load is greater than or equal to the second load and less than or equal to the first load.

3. The blade control system according to claim 2, wherein under the condition that the distance determining part determines that the distance between the designed surface and the cutting edge of the blade is greater than or equal to the second distance and less than or equal to the first distance, the lift cylinder controlling part is configured to keep currently selected one of the dozing control and the grading control when the blade load determining part determines that the blade load is greater than or equal to the second load and less than or equal to the first load.

4. The blade control system according to claim 1, wherein the distance calculating part is configured to calculate the distance between the designed surface and the cutting edge of the blade based on a vehicle information indicating a vehicle state and a designed surface information indicating the designed surface.

5. The blade control system according to claim 4, wherein the vehicle information contains a stroke length of the lift cylinder, a tilting angle of the vehicle body and a GPS data indicating a position of the vehicle body.

6. The blade control system according to claim 4, wherein the designed surface information contains a designed surface data indicating a position and a contour of the designed surface.

7. A construction machine, comprising:

a vehicle body; and the blade control system according to claim 1.

8. The construction machine according to claim 7, further comprising:

a drive unit including a pair of tracks attached to the vehicle body.

* * * * *